United States Patent [19]

Kaladis et al.

[11] Patent Number: 4,810,029

[45] Date of Patent: Mar. 7, 1989

[54] FOLDING STRUT AND JOINT STRUCTURE FOR COLLAPSIBLE ARTICLES

[75] Inventors: Peter H. Kaladis, Hughesdale; Peter Biantes, Elsternwick; Manuel J. Reiderich, Glen Waverley, all of Australia

[73] Assignee: Jessella Pty Ltd., South Yarra, Australia

[21] Appl. No.: 145,889

[22] Filed: Jan. 20, 1988

[51] Int. Cl.[4] ..... A47C 4/00

[52] U.S. Cl. ..... 297/16; 248/159; 403/102

[58] Field of Search ..... 403/102, 101, 100; 297/16; 248/159, 431, 165, 168

[56] References Cited

U.S. PATENT DOCUMENTS

| | | | |
|---|---|---|---|
| 595,134 | 12/1897 | Bastide | 403/102 X |
| 2,127,980 | 8/1938 | Niemann | 403/102 |
| 3,161,973 | 12/1964 | Hastings | 403/102 X |
| 3,305,204 | 2/1967 | Babin | 403/102 |
| 4,047,752 | 9/1977 | Rohr | 297/16 |
| 4,605,261 | 8/1986 | Lee | 297/16 |
| 4,671,566 | 6/1987 | Knapp et al. | 297/16 |

*Primary Examiner*—James T. McCall
*Attorney, Agent, or Firm*—Krass & Young

[57] ABSTRACT

A folding tubular frame structure and subcombination for use in a folding beach and deck chair and in a folding table. The subcombination comprises a cast or machined joint member having the concentric combination of a male insert or stub member and, surrounding said member, an annular groove seat. A tubular strut such as a chair leg fits snugly into the seat and telescopes loosely over the male insert member. A connector member is pivotally pinned into a slot in the end of the stub and receives one end of a tension spring at the outboard end thereof. The tension spring runs through the tubular strut and is fastened to an insert portion of a terminal member such as a foot. The tension spring resiliently urges the foot into the outboard end of the tube and further resiliently urges the tube into the annular slot. However, the spring permits the tube to be pulled from the slot and rotated along with the connector member and spring into a folded position.

8 Claims, 4 Drawing Sheets

Fig-4
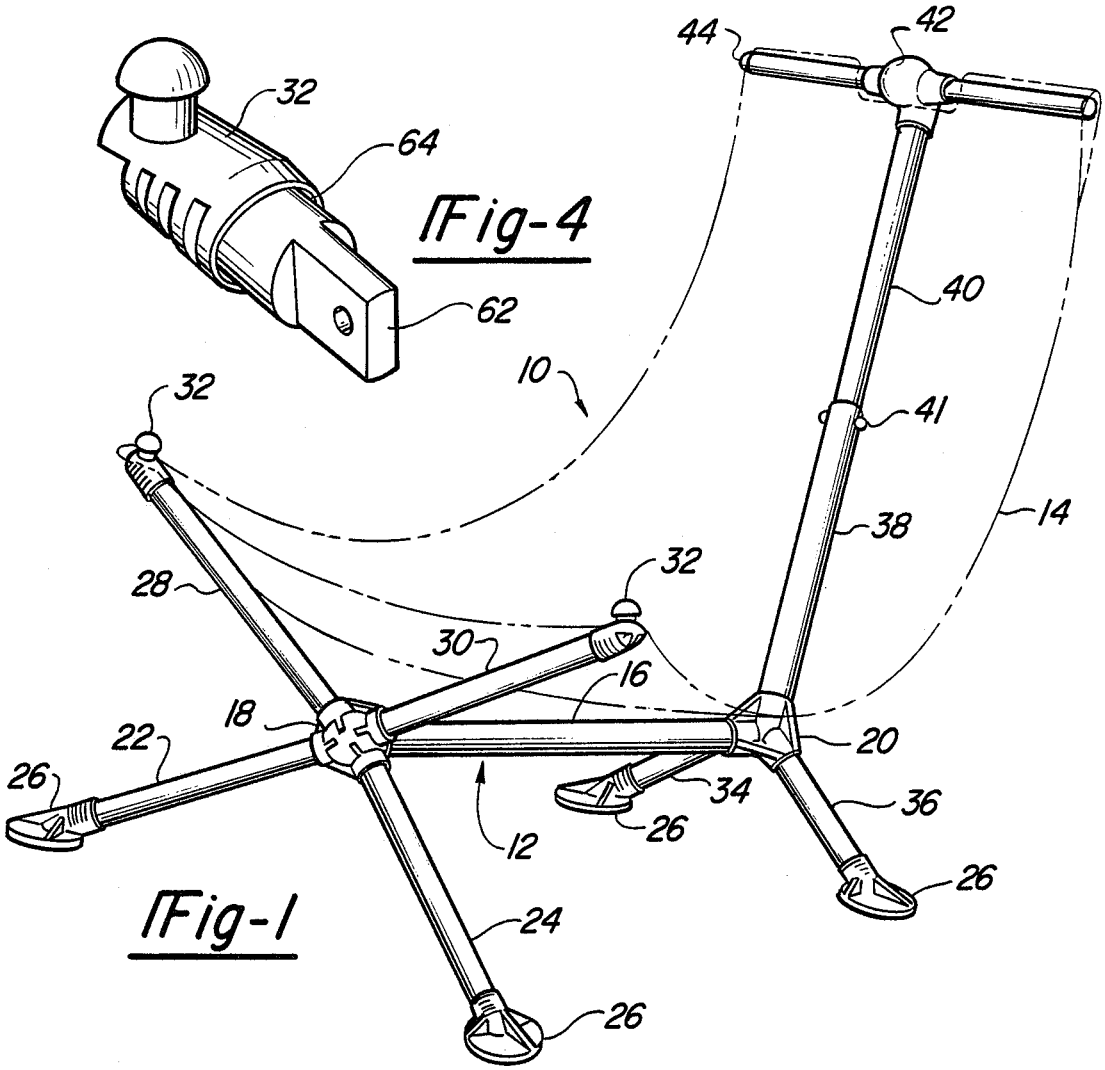
Fig-1
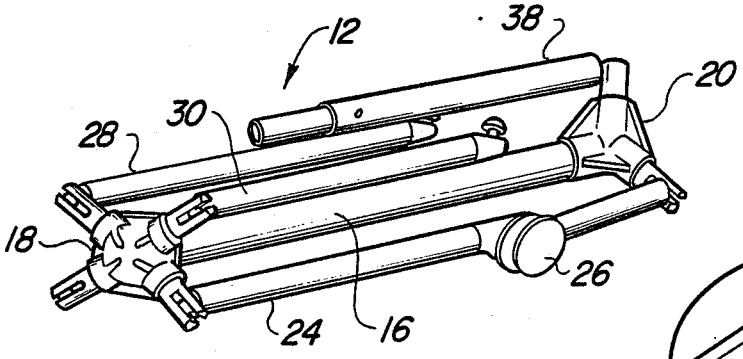
Fig-2
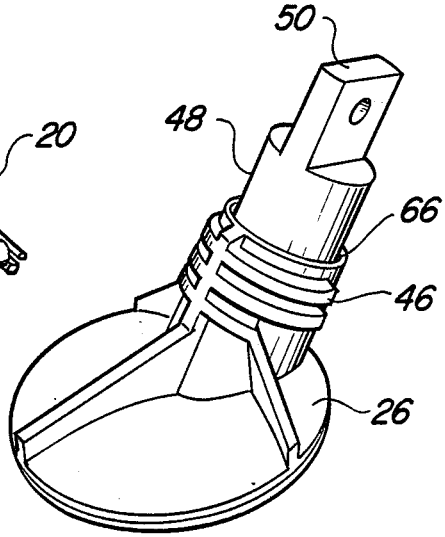
Fig-5

FOLDING STRUT AND JOINT STRUCTURE FOR COLLAPSIBLE ARTICLES

FIELD OF THE INVENTION

This invention relates to foldable strut and joint structures for collapsible articles such as chairs, tables, golf carts and other articles which must provide stable, reliable, load bearing service when in the utility condition but which fold to a low volume condition for storage and transportation.

BACKGROUND OF THE INVENTION AND PRIOR ART

The concept of foldability and/or collapsibility for various articles such as chairs, benches, tables and golf carts has long since been known. Articles of the type just mentioned can be relatively bulky and space-consuming when in the erected utility condition; therefore, it is desirable to collapse or fold the article into a low volume condition for transportation and storage.

Perhaps no article of furniture has received more attention in terms of designing collapsibility or foldability than the chair. Perhaps the best known example is the so-called card table chair in which the seat typically pivots into alignment with the backrest and the forward legs simultaneously move closer to the rear legs.

Two folding chairs which are more relevant to the present invention and which merit comparison for purposes of understanding both the structure and the advantages of the present invention are disclosed in the U.S. Pat. Nos. to Rohr 4,047,752 and Lee No. 4,605,261. Both Rohr and Lee disclose chairs which, in overall concept, are excellent. However, the implementation of the concept in each case creates certain disadvantages.

Both the Rohr and Lee chairs may be characterized as comprising a collapsible tubular metal frame and a fabric or fabric like integral seat and back portion which is easily attached to and removed from the frame at the rear top edge and the front right and left corners of the fabric element. Both the Rohr and Lee frames comprise a front or forward multiple joint member or "spider" for receiving foldable left and right front legs and left and right front seat edge support struts. In addition both Rohr and Lee include as part of their frame a rear foot which is connected to the front joint member by means of a longitudinal strut and which rests upon the ground. Extending rearwardly and upwardly from the foot is a back support strut which is adjustable in length and, at least in Rohr's case, inclination. An obvious disadvantage of the Rohr is the lack of lateral support at the rear foot, giving rise to a relatively unstable or "tippy" chair. Lee appears to solve this problem by providing outboard leg struts attached to the foot. The two chairs are otherwise remarkably similar.

Both the Rohr and Lee chairs exhibit a further disadvantage in the structure of the pivotal connection between the various strut members and the spiders or joints. Rohr is typical in disclosing a telescopic relationship between an outside tube portion of the joint and an inside tubular strut which fits into the outside tubular structure of the joint. The inside tube is stopped against a crosspin which also provides the anchor joint for a wire and spring combination which extends up into the tubular strut and is anchored some distance into the strut by means of a second pin. Accordingly the spring holds the inside strut tube into the outside spider tube when the leg or strut is in the erected condition but permits the inside strut to be pulled out of the outside tube and folded to one side when one desires to collapse the chair.

The Rohr chair lacks stability in the folded condition since the connecting wire 38 lies between the two disconnected tubes and essentially prevents the anchoring of the disconnected strut in any sort of stable position. Moreover the seating of the end of the inside tube against the crosspin 40 will tend to deform the inside tube, especially if it is made of a lighter material such as aluminum. Finally, the use of the crosspin 41 to anchor the spring within the tube of the strut member gives rise to assembly difficulties and requires that the feet and other terminal members of the outwardly extending struts be more or less permanently attached.

Lee suffers from the same disadvantage as far as the anchoring of the tension springs is concerned and therefore suffers the same disadvantage in the assembly operation. Moreover Lee appears to disclose an unnecessarily complicated structure at the joint.

SUMMARY OF THE INVENTION

The principal objective of the present invention is to provide a simplified and easy to assemble foldable strut and joint structure which may be used to advantage in various foldable and/or collapsible articles such as chairs, tables, umbrella poles, golf cart and the like. The invention will be described with reference to a folding deck chair and a folding table but is clearly not limited to such applications.

In general the improved foldable strut and joint structure of the present invention comprises, in combination, a joint member which may be capable of receiving several tubular structural members such as arm and leg struts, at least one tubular strut member, one end of which fits into an annular socket in the joint and receives into said end a male insert or stub member which may be integrally formed with said joint member, a simple connector member which is pivotally connected to the stub portion of the joint, a terminal member such as a foot having a body portion and a stub portion which fits into the opposite or outboard end of the tubular strut, and a tension spring which extends fully through the strut and is connected between the terminal member and the connector member, thereby resiliently holding the terminal member to the tubular strut and the tubular strut within the socket when the strut and joint structure is in the erected position. The spring, however, allows the tubular strut to be easily withdrawn from the socket and swung or folded back to a collapsed position.

Assembly is greatly facilitated since there are no internal pins and internal pin/spring connections mediate the ends of the structural tube or strut and there is no need for a separate fastening procedure or fastening elements to hold the terminal member to the strut.

Various additional features and advantages of the invention will be apparent from a reading of the following specification which describes a preferred embodiment of the strut and joint structure as well as the application of said structure to both chair and table articles. In the preferred form the stub portion of the joint insert is slotted and the connector member is simply pinned into the slot for pivotal movement by means of a crosspin. The annular groove or seat surrounds the male stub portion to receive the end of the tubular strut thereby to prevent flaring or deformation during the useful life of the article. The male stub portion is preferably somewhat greater in length than the diameter of the tubular strut and the pin connection for the connector is well into the slot thereby to provide a full seat or bearing surface for the end of the tubular strut when it is retracted and folded; i.e., the end of the strut lies fully against the protruding stub with the pivotal connector extending directly up into the open end of the tubular strut.

BRIEF DESCRIPTION OF THE DRAWING

FIG. 1 is a perspective view, partly in phantom, of a deck or beach chair embodying the invention;

FIG. 2 is a perspective view of the tubular frame from the deck chair of FIG. 1 but in the folded condition;

FIG. 4 is a perspective view of a terminal member used to secure the left and right front corners of the fabric portion of the chair in FIG. 1 to the frame;

FIG. 5 is a perspective detail of another terminal member, in this case, a foot;

DETAILED DESCRIPTION OF THE ILLUSTRATIVE EMBODIMENTS

Figure 6:
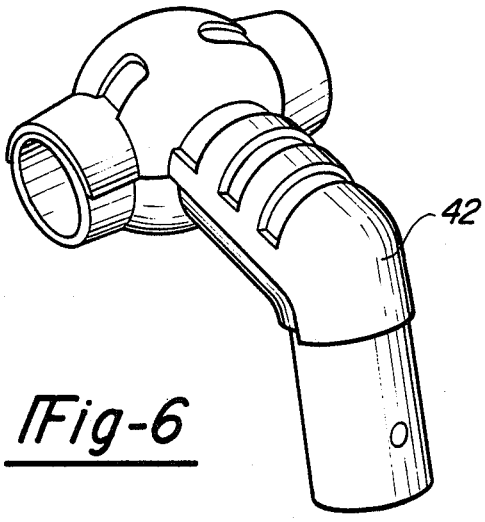
FIG. 6 is a perspective view of a top crossbar detail in the embodiment of FIG. 1.

Referring first to FIGS. 1–11, the details of a collapsible/folding deck and beach chair embodying the invention will be described. Chair 10 comprises a collapsible or folding tubular metal frame 12 adapted to receive a fabric or fabric-like seat and back sling 14. The material of the sling may vary greatly and include such materials as canvas, leather and man-made fabrics. Sling 14 is physically connected to the frame 12 at the rear top and at the left and right front corners as hereinafter described in greater detail.

Frame 12 comprises a longitudinally extending tubular strut 16 non-foldably connected at the opposite ends thereof to rigid metal joint members 18 and 20, respectively. The joint members 18 and 20 may be machined or cast out of a number of materials; economic considerations favor a zinc or zinc alloy casting. Details of joint 18 are better illustrated in FIGS. 7 and 8 while details of joint 20 are better shown in FIGS. 9 and 10.

Joint 18 receives in releasable and foldable fashion a pair of outwardly extending tubular leg struts 22 and 24 which terminate the lower or outboard ends in feet 26. These feet, one of two "terminal members" disclosed herein, may also be cast or machined from various metals but are preferably zinc or zinc-alloy castings. Joint member 18 also releasably and foldably receives oppositely outwardly extending seat support struts 28 and 30 having terminal members in the form of seat support buttons 32. Details of the feet 26 are shown in FIG. 5 whereas details of the seat support buttons are shown in FIG. 4. The seat support buttons 32 are adapted to cooperate with sewn-in eyes, preferably metallic grommets, in the left and right forward corners of the fabric sling 14.

The rear joint member 20 foldably and releasably receives oppositely outwardly and downwardly extending leg struts 34 and 36 which terminate in feet 26. Joint member 20 also receives in a releasable but unsprung connection a back support strut 38 which, in the illustrative embodiment, is kept short to maintain the compactness of the folded frame as shown in FIG. 2. To produce adequate seat back height, a second tube 40 is telescopically interfitted within tubular struts 38 and held in position by means of a spring detente 41 which is constructed in a known manner. The upper tube 40 terminates at the top end in a three-way T casting 42, the transverse bore of which receives a single sling top support crossbar 44, preferably in a tight frictional fit. The top of the sling 14 is turned back and sewn across in a wide and deep hem and notched in the center as shown. Accordingly, the combination of the crossbar 44 and the T terminal 42, in the assembled form, can be pushed through the hem of the sling 14 and the T 42 thereafter assembled to the top of strut 40.

The frame 12, as is apparent from the illustrations of FIGS. 1 and 2, must provide a stable and reliable load-bearing structure for the sling 14 and the persons sitting therein while in the erect condition. Moreover, the frame 12 must, after the sling 14 is removed, collapse to the low volume folded condition shown in FIG. 2 thereby to facilitate transportation and/or storage of the chair. These purposes are accomplished by the specific mechanisms hereinafter described.

Figure 3:
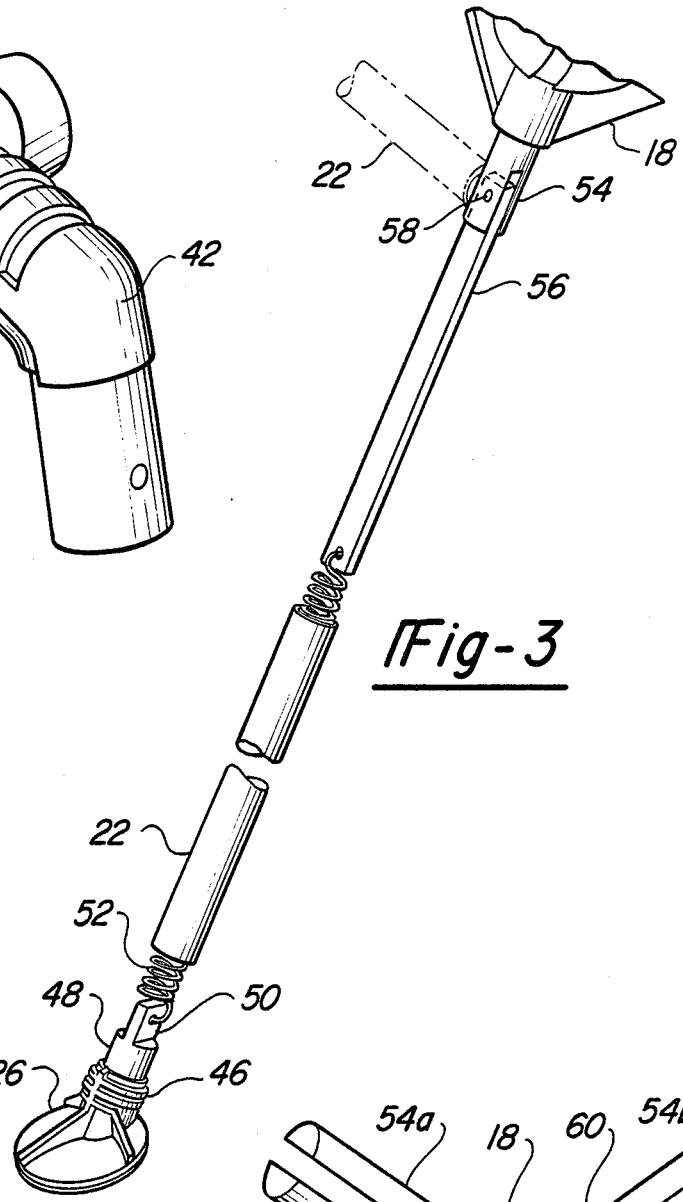
FIG. 3 is an exploded view, with sections broken away, of the structure of the inventive subcombination as it is found in the chair frame of FIG. 1.
Figure 7:
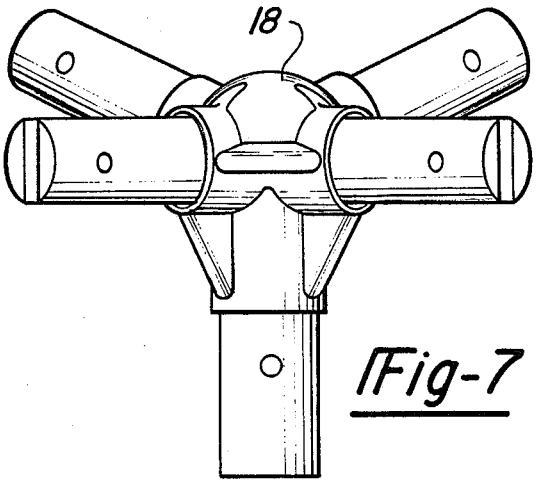
FIG. 7 is a perspective detail of the front joint member in the embodiment of FIG. 1.

Referring to FIG. 3, the foot 26 has an enlarged ribbed body portion 46 contiguous with an integral smaller diameter stub or male insert portion 48 which is narrowed down into a rectangular finger 50 at the outboard extremity thereof. Leg tube 22 houses a tension spring 52 which is connected at one end to the finger 5 of leg 26 and at the other end to a metal connector bar 56 which is secured by pivot pin 58 to the stub or insert portion 54 of the joint member 18. The stub 54 is greater in length than the diameter of the leg strut or tube member 22 and the pivot pin 58 is located far enough back into the slotted end of the stub 54 that the leg tube 22, when folded to the position shown by phantom lines in FIG. 3, has a seat or bearing surface fully against the side of the stub 54.

Figure 8:
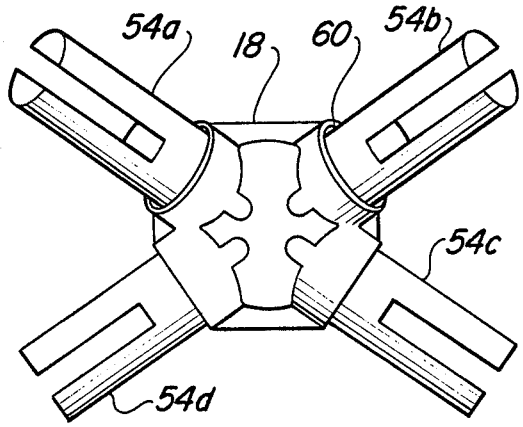
FIG. 8 is another view of the front joint member.
Figure 9:
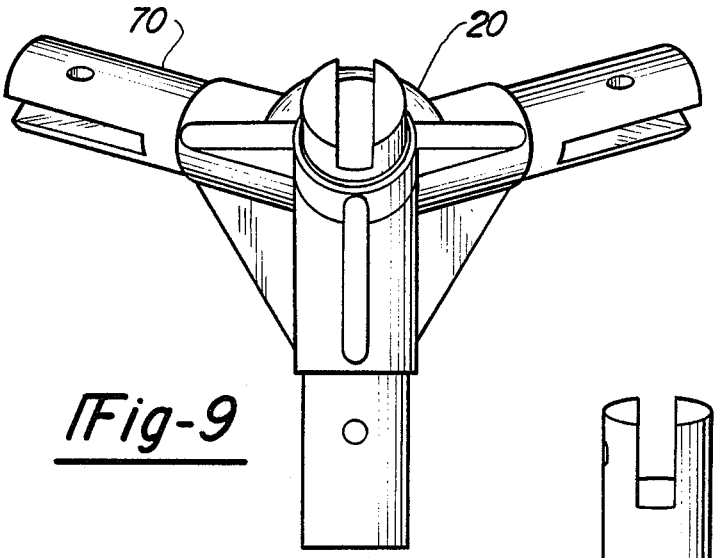
FIG. 9 is a perspective view of the rear joint member in the embodiment of FIG. 1.

The stubs **54*a*, 54*b*, 54*c* and 54*d* of the joint member 18, as shown in FIGS. 8 and 9, are all deeply slotted and all exhibit a length which is substantially greater than a diameter of the associated tubular strut member such as 22. Each of the stub members 54 is concentric with a shallow annular ring groove 60 which is of suitable diameter as to comfortably receive the inboard end of the tubular strut 22 with which the particular stub 54 is associated. All of the tubular struts 22, 24, 28, 30, 34 and 36 are preferably of the same diameter and are preferably made of the same material; e.g., steel or aluminum. Accordingly, the tubular struts, for example 22, when in the erected or non-folded condition, is urged by the action of the tension spring into the annular slot 60 and against the bottom seat surface thereof in the joint 18. As can also be seen in FIG. 3, the tension spring 52 pulls the male insert portion 48 of the foot 26 into the lower end of the leg strut 22, maintaining the leg 22 in the condition shown in FIG. 1** in a very stable and secure fashion.

To fold the leg strut 22, one simply grasps the leg strut and pulls it outwardly from its seating arrangement within the annular slot 60 far enough to bare the pivot pin 58 and clear the tube off of the end of the stub or insert member 54. Tube 22 is then rotated 90 degrees to the position shown by phantom line in FIG. 3 and allowed to spring back into a seating relationship against the side of the stub member 54.

The terminal members 32 and 26 may also be constructed in such a way as to exhibit both the male stub or insert portions and the surrounding annular slot to provide seating surfaces for the outboard ends of their associated tubes or struts. By way of first example, FIG. 4 shows the sling buttons 32 to have insert or stub portions 62 and concentric annular grooves 64. By way of second example, FIG. 5 shows the foot to have a short insert or stub member 40 surrounded by a concentric annular groove or slot 66. Except for their functional external qualities, the terminal members represented by foot 26 and button 32 are the same.

Figure 11:
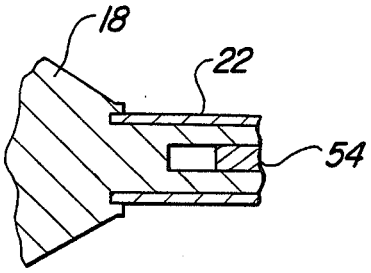
FIG. 11 is a detail of the joint member of FIG. 10 showing the interfitting relationship of a strut with the joint.

FIG. 11 illustrates the detail of the relationship between the leg strut 22 and the joint member 18 including the fashion in which the strut 22 fits within the annular slot around the stub or male insert portion. The annular slot is found to be preferable to a non-slotted arrangement in that it avoids flaring of the end of the tube 22 when loaded. This is particularly important when constructing the frame 12 out of relatively soft aluminum tubing but adds life and stability to the structure of the frame 12 regardless of the material construction.

Figure 10:
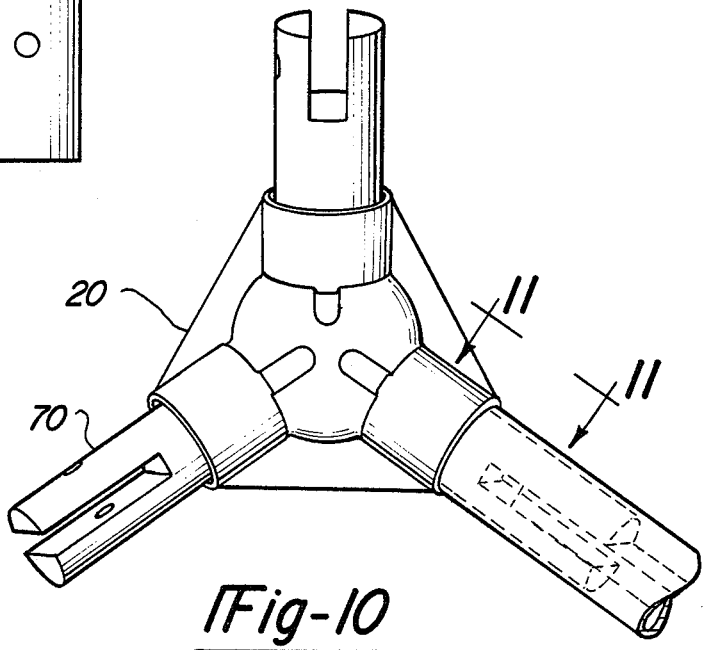
FIG. 10 is another perspective view of the joint member.

The rear joint 20 shown in FIGS. 9 and 10 is, except for specific configuration and the number of stub portions 70, very similar to the forward joint member 18. Accordingly, member 20 will not be described in detail. Suffice it to say that it is adapted with stubs and sockets or annular grooves to receive the rear leg struts 34 and 36 in precisely the same manner as the front joint member 18 receives the legs 22 and 24. In addition, rear joint member 20 receives in an unsprung but foldable condition the lower seat back tube 38. This connection may be provided by means of a connector member which is pinned into the upwardly and rearwardly extending stub of the rear joint 20. The other end of the connector is attached by means of a slack cord or the like to the inside of the tube, possibly to the spring member 41 which provides a snap-fit connection between the tubes 38 and 40.

Figure 12:
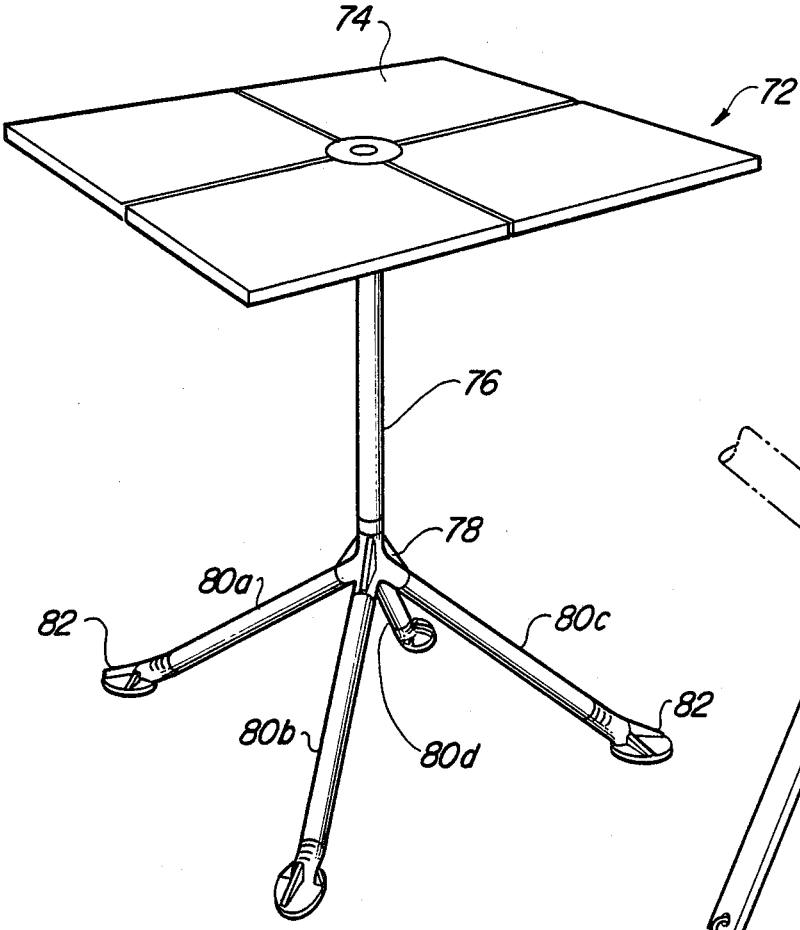
FIG. 12 is a perspective view of a folding/collapsible table embodying the invention.
Figure 13:
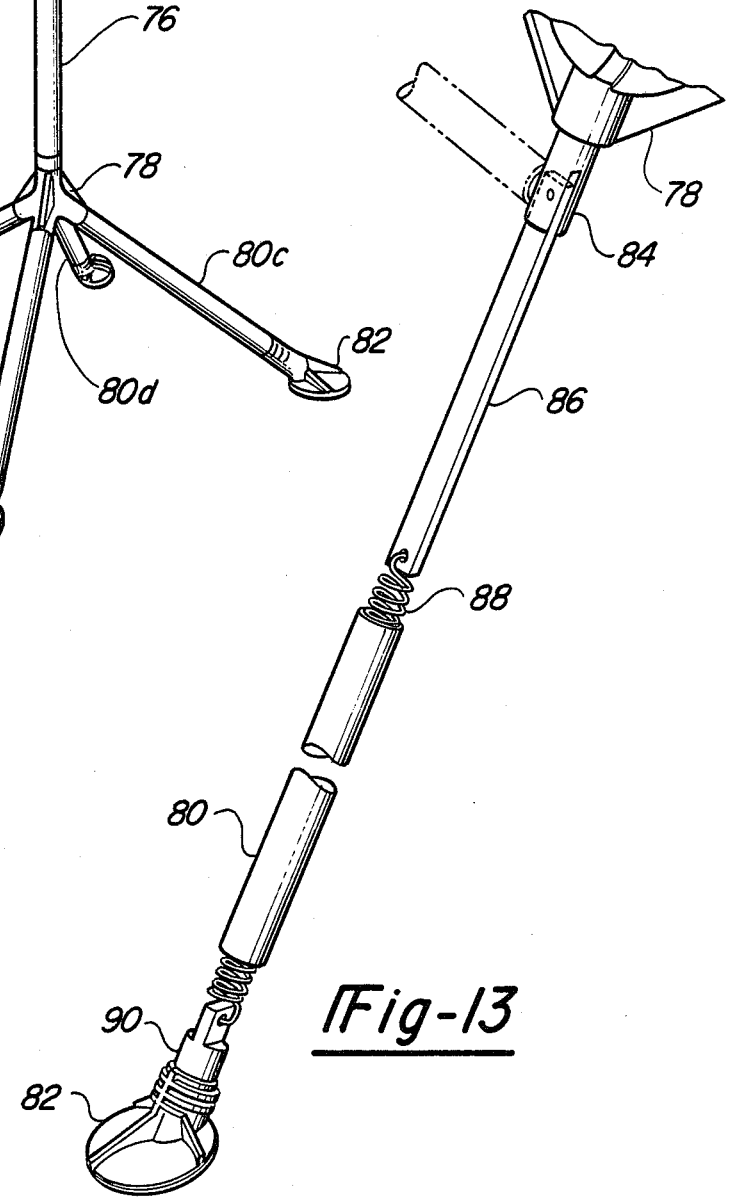
FIG. 13 is a detail of a table leg from FIG. 12 showing similarity to FIG. 3.

Referring now to FIGS. 12 and 13, the invention is shown incorporated within a collapsible camping table 72 comprising a top worksurface 74 and a frame 76,78,80,82. The details of the worksurface 74 are unimportant except to observe that they preferably provide collapsibility or foldability and attach suitably to a flange on the top of the vertical support strut 76. Strut 76 may non-foldably attach to a cast or machined joint member 78 which is constructed very similar to either of joint members 18 and 20, thereby to foldably and collapsibly receive tubular leg struts 80*a*, 80*b*, 80*c* and 80*d*. Each of the tubular leg struts 80 terminates at the outboard end in a cast or machined foot 82 which is identical to the foot 26 illustrated in FIG. 5.

The details of the folding leg strut assembly are shown in FIG. 13 to comprise a male insert or stub member 84 integral with and extending outwardly from the cast or machined metallic joint member 78. A flat metal connector 86 is pivotally pinned into a slot in the stub 84 and provided with a hole 88 in the opposite end to receive one end of a tension spring 88. Spring 88 extends fully through the leg tube 80 and is hooked into the inboard end of a stub or male insert portion 90 of the foot 82. The tension spring 88 thus urges the foot 82 into the outward end of the tube 80 and further urges the inner end of the tube 80 into an annular groove and seat in the joint member 78 which is constructed as the same fashion as the groove 60 shown in FIG. 8. When one wishes to fold or collapse the legs of the table 72, one grasps the tube 80, pulls it axially outwardly from the groove to expose the pivot pin in the stub 84, and then rotates the tube through 90 degrees and allows it to spring back into a seating relationship on the side of the stub 84.

The invention has been described with respect to specific embodiments. This description is not to be construed in a limiting sense.

We claim:

1. For use in a folding apparatus, a structural strut subcombination comprising:

a tubular structural member;

a joint member adapted to receive said tubular structural member in each of a load carrying, extended position and a folded position and comprising an annular socket for receiving one end of said tubular member and, concentric with said socket, a plug portion which extends axially into said one end of said tubular member when said tubular member is inserted into said socket;

connector means pivotally connected to said plug and adapted to extend into said on end of said tubular member;

a terminal member having an enlarged body portion and a stub portion adapted to fit into the opposite end of said tubular structural member; and a tension spring connected between the connector and the stub of said terminal member to bias said terminal member into said opposite end and to bias said tubular member into said socket but resiliently yielding to permit said tubular member to be withdrawn from said socket and pivoted relative to said plug portion thereby to assume said folded position.

2. Apparatus as defined in claim 1 wherein the effective length of said plug portion of said joint member is greater than the diameter of said tubular structural member, said pivot means being located in said plug portion such that the end of said tubular member bears against said plug on both sides of said pivotal connection when said tubular member is in the folded position.

3. Apparatus as defined in claim 1 wherein said terminal member is a foot.

4. Apparatus as defined in claim 1 wherein said terminal member is a button member for receiving the eye of a fabric chair seat.

5. Apparatus as defined in claim 4 wherein said opposite end of said tubular member and said stub portion of said terminal member are matingly shaped to resist rotation of said terminal member relative to said tubular member.

6. Apparatus as defined in claim 1 wherein said tubular structural member is a support leg of an article of furniture.

7. Apparatus as defined in claim 1 wherein the tubular structural member is a table leg.

8. A collapsible chair comprising in combination:

a fabric or fabric like seat portion having a top edge and left and right front corners;

a tubular support frame comprising, in combination, a longitudinal base member;

first and second multiple-connector joint members each adapted to receive a plurality of tubular structural members, said joints being nonfoldably connected to opposite ends of said longitudinal base member;

first and second oppositely outwardly extending tubular legs struts connected to opposite sides of the first joint member;

third and fourth oppositely outwardly extending tubular strut members connected to said second joint member;

first and second oppositely outwardly and upwardly extending chair seat support struts connected to said first joint member;

a back support strut connected to said second joint member and extending rearwardly and upwardly therefrom;

means for connecting the top of said back support strut to the top edge of said fabric seat portion;

each of said leg struts having foot members inserted into the outside ends thereof;

each of said seat support struts having button type connector members inserted into the respective ends thereof for receiving eyes in the front left and right corners of said seat surface;

each of said leg struts and seat support struts being foldably connected to the respective joint members, each of said foldable connections comprising an annular socket in one of said first and second joint members for receiving the inboard end of a tubular member and, concentric with said socket, a male plug portion which extends into the inboard end of the tubular strut when the tubular strut is inserted into the socket, a connector pivotally connected to the male plug portion and extending into the inboard end of said tubular structural member, and a tension spring connected between the connector member and the terminal member at the outboard end of said strut to resiliently bias the terminal member into the strut and to further resiliently bias the strut into the socket, the spring, in each case extending fully through the strut.

* * * * *